US006708439B1

(12) United States Patent
Laitala

(10) Patent No.: US 6,708,439 B1
(45) Date of Patent: Mar. 23, 2004

(54) ADJUSTABLE MOUNT FOR RIFLE SIGHT

(76) Inventor: Elmer Laitala, 1729 Harbor St., Ogilvie, MN (US) 56358

( * ) Notice: Subject to any disclaimer, the term of this patent is extended or adjusted under 35 U.S.C. 154(b) by 0 days.

(21) Appl. No.: 10/366,957

(22) Filed: Feb. 13, 2003

Related U.S. Application Data

(60) Provisional application No. 60/356,783, filed on Feb. 13, 2002.

(51) Int. Cl.[7] ..... F41G 1/38

(52) U.S. Cl. ..... 42/126; 42/124

(58) Field of Search ..... 42/126, 124, 125, 42/146, 127, 128, 137, 148, 75.01, 141

(56) References Cited

U.S. PATENT DOCUMENTS

| | | | | | |
|---|---|---|---|---|---|
| 843,183 | A | | 2/1907 | Smith | 33/50 |
| 880,310 | A | | 2/1908 | Klousnitzer | 33/50 |
| 1,083,288 | A | | 1/1914 | Lowe | 33/50 |
| 1,361,063 | A | | 12/1920 | Joeck | 33/247 |
| 1,459,944 | A | * | 6/1923 | Belding | 42/126 |
| 1,613,807 | A | * | 1/1927 | Rutherford et al. | 42/126 |
| 1,770,451 | A | | 7/1930 | Baker | 33/50 |
| 1,974,016 | A | * | 9/1934 | Doe | 42/126 |
| 2,004,489 | A | * | 6/1935 | Kuhn | 42/126 |
| 2,101,037 | A | | 12/1937 | O'Neil | 33/50 |
| 2,143,167 | A | | 1/1939 | Pechar | 33/50 |
| 2,155,391 | A | | 4/1939 | Arden | 33/50 |
| 2,165,796 | A | | 7/1939 | Humeston | 33/50 |
| 2,208,913 | A | | 7/1940 | Unertl | 33/50 |
| 2,224,783 | A | * | 12/1940 | Gibbs | 42/126 |
| 2,336,107 | A | | 12/1943 | Litschert | 33/50 |
| 2,491,431 | A | | 12/1949 | Unertl et al. | 33/50 |
| 3,040,433 | A | | 6/1962 | Heinzel | 33/50 |
| 3,374,544 | A | | 3/1968 | Pitchford | 33/50 |
| 3,826,012 | A | | 7/1974 | Pachmayr | 33/246 |
| 4,397,107 | A | | 8/1983 | Holden | 42/1 |
| 4,756,111 | A | * | 7/1988 | Lapier | 42/128 |
| 5,063,677 | A | | 11/1991 | Millett | 33/252 |
| 5,101,590 | A | | 4/1992 | Hawkins | 42/101 |
| 5,274,941 | A | | 1/1994 | Moore | 42/101 |
| 5,400,539 | A | | 3/1995 | Moore | 42/101 |
| 5,428,915 | A | | 7/1995 | King | 42/101 |
| 5,493,450 | A | | 2/1996 | Ekstrand | 359/799 |
| 6,622,415 | B1 | * | 9/2003 | Canaday et al. | 42/140 |
| 2003/0192224 | A1 | * | 10/2003 | Kirk | 42/124 |

* cited by examiner

*Primary Examiner*—Michael J. Carone
*Assistant Examiner*—Denise Buckley
(74) *Attorney, Agent, or Firm*—Albert W Watkins

(57) ABSTRACT

A precision mount has two split rings that directly engage a telescopic sight. The front split ring is mounted on shoulder bolts to provide a pivoting engagement, while the rear split ring is held within a slide and adjusted vertically therein using a precision adjuster. A balanced lock is provided which ensures alignment is preserved during position locking, subsequent to adjustment. Windage is provided on a separate adjustment between the sight yolk and the rifle attachment, thereby isolating windage from position locking and simplifying the appropriate adjustments. Precision connections are maintained at all critical locations, even after shock or recoil, by using precisely dimensioned pins and mating holes in association with standard bolt fasteners.

13 Claims, 3 Drawing Sheets

ADJUSTABLE MOUNT FOR RIFLE SIGHT

CROSS REFERENCE TO RELATED APPLICATIONS

This application claims priority to U.S. provisional patent application serial No. 60/356,783 filed Feb. 13, 2002 and abandoned herewith.

BACKGROUND OF THE INVENTION

1. Field of the Invention

This invention pertains generally to sights such as might be used, for exemplary purposes only, in combination with various projectiles and firing devices. In a more specific manifestation, the invention pertains to mounts used on telescopic sights commonly used for very long distance sighting in association with a rifle or the like.

2. Description of the Related Art

Many years have passed since the first rifles were designed. The original rifles had very little precision, and were equally limited in distance a bullet would travel. With these rifles, the barrel served as an adequate aligning tool. Gradually, new designs permitted riflemen to fire accurately at greater distances, which then led to a need for better ways to align the rifle with an intended target. Early techniques included the use of two small protrusions that extended vertically above the rifle barrel but which formed a common axis with the barrel. These sights were replaced by v-sights still in use today on some modern short-range rifles, where the sight closest to the rifleman's eye is formed in the shape of the letter "v", and the forward sight may be an edge or protrusion with a small ball on the top thereof. In practice, the shooter will align the ball or top of the protrusion centered and at the top of the "v". This type of sighting technique is reasonably accurate to only tens of yards, and then loses too much accuracy to be of any use. Other early sights included the leaf sight, and peep sights where the "V" or "U" is replaced by a closed cylinder, forming a small alignment hole. Commonplace with peep sights are hooded front sights, where a small cover is placed over the front sight to reduce the distortion effect of uneven lighting, such as sunlight from one direction or the other, that might otherwise lead to optical misalignment.

As distances increased through improved firing techniques, better bullets and improved barrels, better sights also had to be designed. The telescopic sight, which is essentially a low magnification sighting telescope mounted adjacent the rifle barrel and on an axis roughly parallel thereto, has now become the predominant sight for longer distance shooting. Several benefits are attained, the first which is the additional magnification of the target, which at modem firing distances can be very helpful. A second feature of the telescopic sight in common use today is the elevation and windage adjustment for an internal cross-hair, which permits a shooter to compensate for bullet drop that will occur over distance, in accordance with the laws of physics and gravity, and windage, which is a horizontal or side-to-side adjustment that is made to compensate for drift brought on by a cross-wind. This combination of magnification, internal cross-hairs, and compensation for windage and bullet drop has served the needs of the industry for many years.

Greater shooting distances continue to be sought after, and the physical limitations of the telescopic sight prevent this type of sight from fulfilling desired objectives without some further modification or compensation. Several factors must be taken into consideration for a long distance sight. The first is the desired magnification and field of view. In order to increase field of view at a given magnification, it is customary to enlarge optical components. Unfortunately, the size of the sight is limited by physical relation to the rifle, greater manufactured cost of larger components, and also by the weight that larger optical components and all associated necessary structure add: Said another way, a very large telescope is by definition very bulky, very heavy, very expensive, and requires very special mounting hardware to keep the optics in proper alignment after exposure to firing recoil.

In order to minimize the expense of the telescopic sight, while still permitting compensation for greater distances than would be attainable with the sight components alone, several artisans have proposed adjustable mounting structures for telescopic sights. These adjustable mounts permit the sight to be used at firing distances greater than can be compensated for with the ordinary bullet drop and windage adjustments available on a traditional sight. Exemplary among these patents are U.S. Pat. No. 1,083,288 to Lowe and U.S. Pat. No. 4,397,107 to Holden, each which are incorporated herein by reference in their entirety for their teachings of sights and mountings and the other more general knowledge of the field presented therein. The Holden patent illustrates an approach wherein a top adjustable setting screw is calibrated to permit bullet drop adjustment with relative precision. An adjustable screw member is designed to protrude within a scope mount and extend downward an adjustable distance. Counteracting this downward force is a spring loaded member that extends from the bottom and side up to the scope tube, while two additional side screws are provided for anchoring the scope horizontally within a split mounting ring. Unfortunately, with the Holden design, the scope housing is supported only by each of the four adjustable screws, which leads to a concentration of force and stress upon very small areas of the telescopic sight tube. Given the substantial recoil that may be endured, especially when firing with long-range bullets, the possibility for damaging the scope either during adjustment or during firing is too great. Furthermore, even small flexures within the scope tube housing will lead to inaccurate distance settings by the rifleman, since the adjustment screw will travel into and flex the scope housing without actually changing the angular orientation of the scope. Finally, in the event of recoil, the telescope tube may move and cause both impact damage and frictional wear to the tube, since the tube is reliant upon support from a spring loaded pin. This design is therefore very restrictive in terms of what size and weight of telescopic sight may be permitted for a given firing load and intended shooting distance.

The Lowe patent, which is interestingly of much earlier origin, offers several features that alleviate some of the limitations of Holden. For example, in the Lowe patent, split rings are used to directly clamp about the sighting tube. A secondary framework is provided within which the clamping ring travels. Final position is selected by adjustment with a special thumb wheel and beveled surface, and then the position is locked into place with either a side-mounted screw or a screw and nut combination coming from below the split ring. Unfortunately, using this technique the side mounted screw will tend to pull the sight out of linear alignment with the gun barrel, essentially creating the need for an otherwise unnecessary windage adjustment. Since the Lowe patent provided no convenient way to make such an adjustment, this Lowe design was probably deemed unworkable at the time by other artisans.

Since the time of Lowe, there have been numerous additional U.S. patents promulgated that provide two axis adjustment of a sight. These include U.S. Pat. No. 843,183 to Smith; U.S. Pat. No. 1,361,063 to Joeck; U.S. Pat. No. 2,101,037 to O'Neil; U.S. Pat. No. 2,143,167 to Pechar; U.S. Pat. No. 2,165,796 to Humeston; U.S. Pat. No. 2,208,913 to Unertl; U.S. Pat. No. 2,336,107 to Litschert; U.S. Pat. No. 2,491,431 to Unertl et al; U.S. Pat. No. 3,040,433 to Heinzel; U.S. Pat. No. 3,374,544 to Pitchford; and U.S. Pat. No. 3,826,012 to Pachmayr; each which are incorporated herein by reference for their teachings relevant to the art and to the present specification. In spite of the long need and extensive development, there is still a need in this industry for a precision mount that will accommodate existing telescopic sights and extend the useful range thereof.

SUMMARY OF THE INVENTION

Exemplary embodiments of the present invention solve inadequacies of the prior art by providing a precision mount having two split rings that directly engage a telescopic sight. The front split ring is mounted on shoulder bolts to provide a pivoting engagement, while the rear split ring is held within a slide and adjusted vertically therein. A balanced lock is provided which ensures alignment is preserved during position locking. Windage is provided on a separate adjustment between the sight yolk and the rifle attachment, thereby isolating windage from position locking and simplifying the appropriate adjustments.

In a first manifestation, the invention is an adjustable mount for attaching a longitudinally extending sight to a gun barrel. A first pivotal mount affixes the sight at a first location permits rotation relative to the mount. A second adjustable mount generally encompasses and retains the longitudinally extending sight distal to the first location. The second adjustable mount generally encompasses the sight to distribute forces transmitted from gun barrel to sight about a circumference of the sight. A yoke adjacent the second adjustable mount restrains the second adjustable mount against motion perpendicular to an arcuate path extending radially the first pivotal mount and thereby maintains general longitudinal orientation of the longitudinally extending sight. A guide is cooperative with the yoke and second adjustable mount to restrain motion of the second adjustable mount with respect to the yoke to follow the arcuate path radially about said first pivotal mount. A locking fastener has means cooperative with yoke, adjustable mount and guide which operatively locks the second adjustable mount into place relative to the yoke in one of a plurality of angular orientations with respect to the first pivotal mount, and provides balanced forces about the second adjustable mount to maintain longitudinal orientation of the sight during locking.

In a second manifestation, the invention is a rifle mount for supporting a telescopic sight upon a barrel having compensation adjustments of vertical angle for bullet drop and horizontal angle for windage that exceed any adjustments available within the telescopic sight. A forward support for the telescopic sight is pivotal about a first horizontal axis and Secured against motion about a vertical axis. A rearward support for the telescopic sight is pivotal about the first horizontal axis and is secured against motion about a vertical axis. A means is provided for accurately measuring an angle of orientation between telescopic sight and rifle barrel. A means is provided that is cooperative with the rearward support for locking the rearward support against motion about the first horizontal axis. A means for supporting the rearward support relative to rifle barrel is pivotal about a vertical axis, and a means is provided for locating the rearward support at a second angle of orientation measured upon a vertical axis between telescopic sight and rifle barrel.

In a third manifestation, the invention is a gun mount for mounting a telescopic sight to a gun. The mount has a forward yoke, and a means for pivotal attachment between forward yoke and telescopic sight that is rotatable about an axis compensating for bullet drop. A rearward yoke is rigidly aligned with the forward yoke, and a means is provided for supporting the telescopic sight within the rearward yoke and locking the sight relative thereto. A base has means to anchor rigidly to the gun, and a means is provided to pivot the yokes about the base about an axis compensating for windage.

OBJECTS OF THE INVENTION

A first object of the invention is to provide a precision telescopic sight mount that will accommodate existing telescopic sights and extend the useful range thereof. A second object of the invention is to isolate windage from elevation position locking. Another object of the present invention is to provide durable means for supporting the telescopic sight that avoids any damage or loss of precision that might otherwise result. A further object of the invention is to ensure precision using existing manufacturing techniques. Yet another object of the present invention is to fulfill the foregoing objectives using available components, where suitable, to benefit from existing volume manufacture and parts availability.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
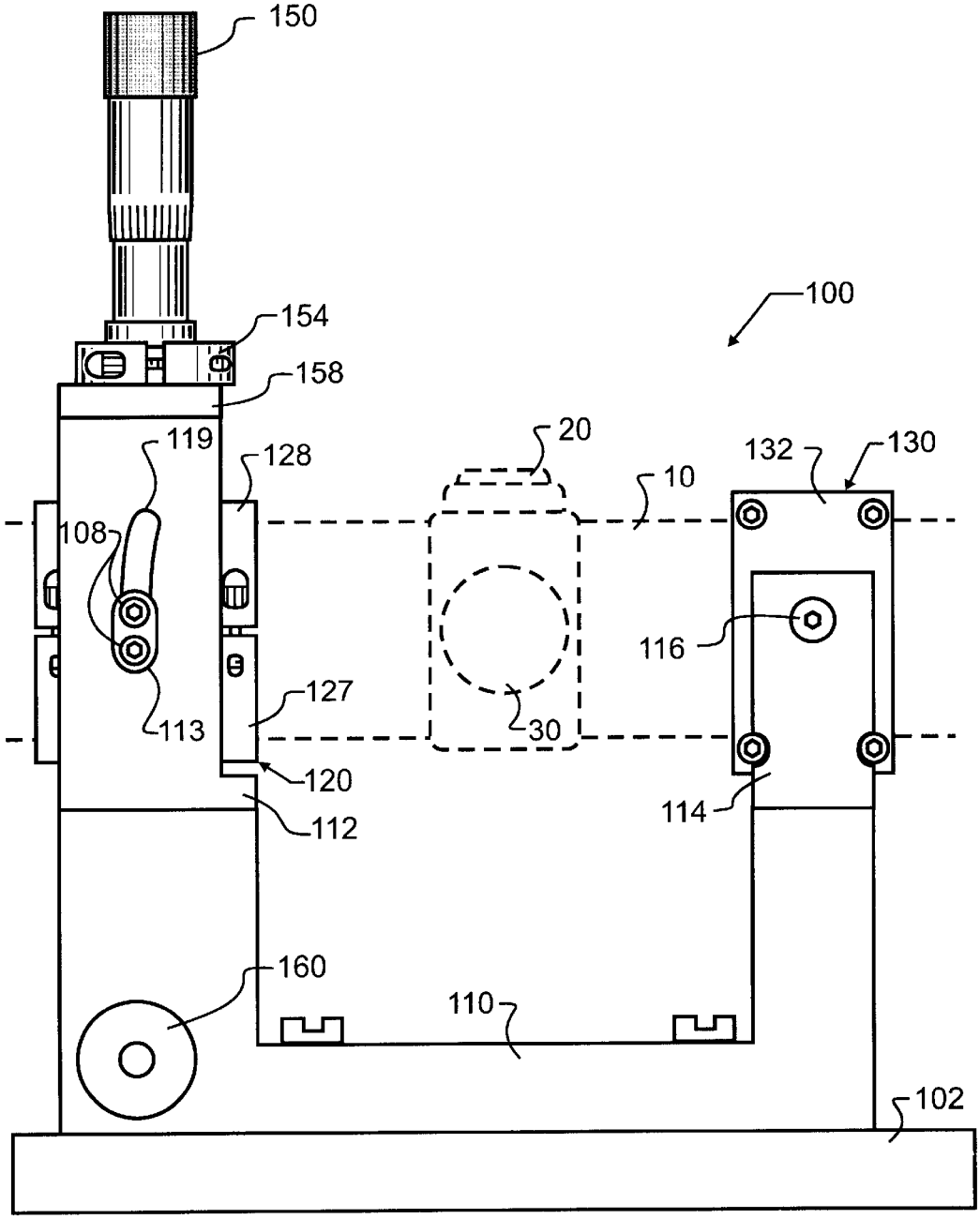
FIG. 1 illustrates a preferred embodiment telescopic sight mount designed and manufactured in accord with the teachings of the present invention from side plan view with the telescopic sight shown in dashed lines for exemplary purposes.

In the most preferred embodiment of the invention, an adjustable mount 100 supports a standard telescopic sight 10. While the construction, details or features of sight 10, including the telescopic nature, are not critical to the present invention, sight 10 will typically and most preferably have internal adjustable cross-hairs or similar sighting aids which are adjustable for fine deviations in both of two axes. Typically, a first adjustment 20 will adjust the up and down movement of the sighting aid, while a second adjustment 30 will change the left and right direction. Those skilled in the art of sights will understand that the up-down adjustment 20 is typically used to set a particular distance to a target, to compensate for vertical height lost during the travel of a projectile from the sight to target, while the left-right adjustment 30 is used to compensate for side deviations such as might occur with a cross-wind. The use of this type of sight 10 is not critical to the invention, but is preferred since very fine adjustments are complimentary to the preferred embodiment mount 100, as will be described herein below.

A support bar 110 spans two generally U-shaped vertical yokes 112 and 114, and also provides an interconnection to a rifle, gun, or other device through base 102 for which a sight of the nature of sight 10 or mount 100 is desired. Vertical yokes 112, 114 support sight clamping rings 120 and 130, respectively. In the preferred embodiment mount 100 illustrated herein, clamping rings 120, 130 are each made from two generally semicircular segments that are held together with bolts or similar fasteners. Clamping ring 120 has a lower semicircular segment 127 and an upper semicircular segment 128, each visible in FIG. 1, while clamping ring 130 has a right semicircular segment 132 visible in FIG. 1. Each clamping ring 120, 130 is most preferably designed to have an inner diameter which is slightly larger than the outer diameter of the sight 10 about which the clamping ring will be affixed, to fit securely thereto without crushing. A slight difference in diameters ensures that clamping rings 120, 130 will always be adjustable to be clamped tightly against sight 10, regardless of small manufacturing tolerances. While this method of attachment is most preferred, it is not critical to the operation of the invention, and other techniques for fastening to telescopic scope 10 may be provided as known in the art. Nevertheless, split rings as illustrated or similar known techniques are preferred to ensure distribution of forces transmitted from the gun barrel to sight during firing, thereby preventing damage or deformation of the sight. This distribution of forces, rather than point forces created by others in the prior art, is important for continued operation of the mount and sight.

Clamping ring 120 is adapted to slide within a center of yoke 112, thereby raising or lowering sight 10. However, clamping ring 130 only pivots about shoulder bolts 116 with respect to yoke 114. Therefore, raising or lowering ring 120 with respect to yoke 112 changes the sighting point on a target. Said another way, raising or lowering clamping ring 120 within yoke 112 will change the angle between the axis of scope 10 and the longitudinal axis of support bar 110. Consequently, a point within the cross-hairs will be shifted higher or lower as a result of the movement of clamping ring 120 within yoke 112, without changing where the rifle barrel is directed. Those familiar with sighting will recognize that this is the basic goal of an adjustable sight. This adjustment allows a rifleman to change the angle between scope and gun barrel to compensate for changes in distance or air currents between gun and target. Most preferably, yoke 112 will restrain clamping ring 120 to motion only along the arcuate path pivoting about the front clamping ring 130, and will restrain against motion perpendicular to this arcuate path. Shoulder bolts 116 comprise the preferred embodiment method of providing a pivotal connection between yoke 114 and clamping ring 130. Nevertheless, other techniques for providing the necessary pivotal motion may be used alternatively, such as precision bearings or the like. Most preferably, the pivotal connection will restrict motion in any direction other than about the pivotal axis.

Visible in FIG. 1 are also two small bolts 108 which pass through a plate 113, through arcuate slots 119 cut in yoke 112, and into mating holes in clamping ring 120, where they are secured. The tightening of screws 108 will create force between plate 113 and yoke 112, thereby locking clamping ring 120 in place with respect to yoke 112. By using a total of four screws 108, two on each side of yoke 112, the careful tightening thereof will keep clamping ring 120 centered, and consequently not affect the windage adjustment described herein below. Other fasteners or fastening means may be provided. An important feature, however, is the provision of balanced forces about the yoke 112 and clamping ring 120 to maintain proper longitudinal orientation of the sight with respect to gun barrel. Arcuate slots 119 may actually be straight or only slightly arced, depending upon the width of the slot and the amount of travel required. The difference in width between arcuate slot 119 and outer thread diameter of screws 108 will provide some tolerance that reduces the amount of arcing required, and which will in some cases eliminate the need for any arcing at all.

Figure 2:
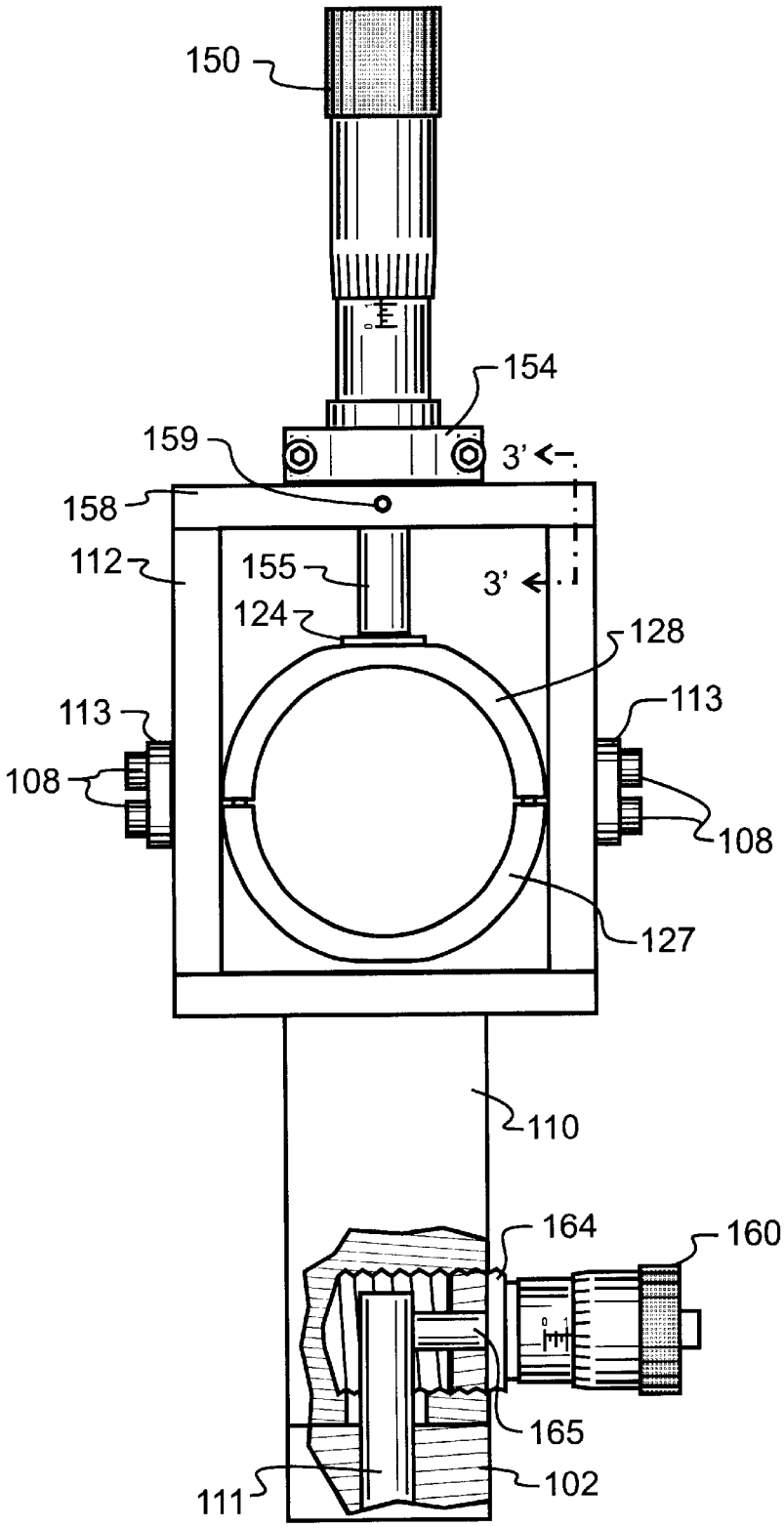
FIG. 2 illustrates the preferred sight mount of FIG. 1 from end plan view, and showing a cut-away of the windage adjustment therein.
Figure 3:
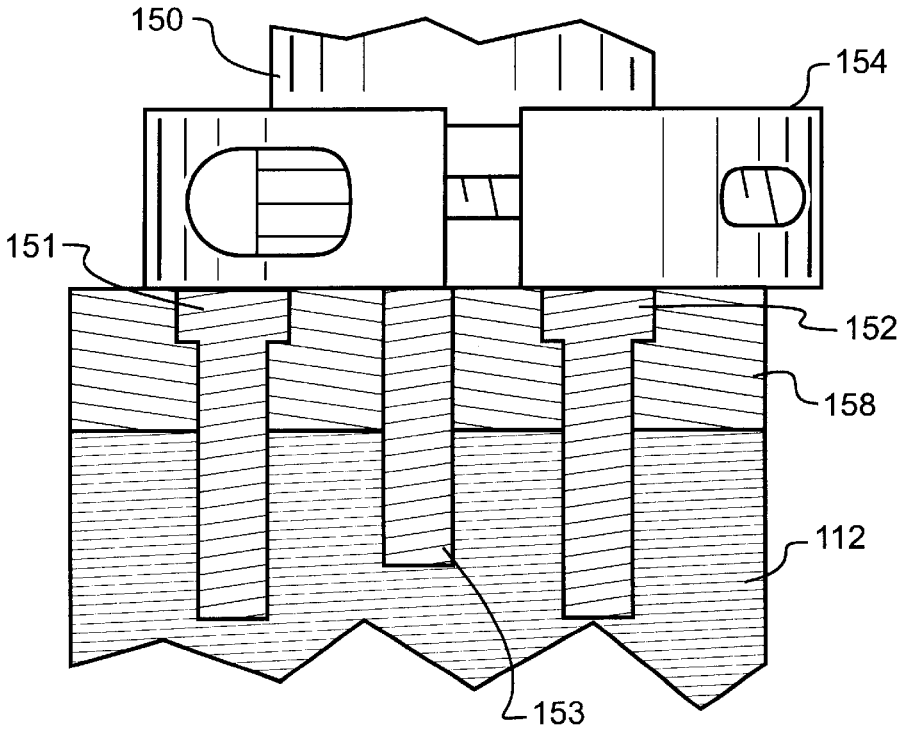
FIG. 3 illustrates by sectional view along line 3' of FIG. 2 one preferred bolt and pin fastener combination that may preferably be used, or the likeness thereof, at all suitable dimensionally critical connections throughout the preferred embodiment telescopic sight mount.

At the top of yoke 112 is a gauge 150, which in the preferred embodiment is a very precise instrument such as a long travel micrometer-type gauge or head commonly used on precision measuring instruments. The type of gauge used in the implementation of the preferred embodiment is not critical, and other measuring instruments, either electronic, electromechanical, mechanical, sonic or otherwise will be selected by those skilled in the art after a reading of the present disclosure. FIG. 3 illustrates the internal connection of gauge 150 to yoke 112 and clamping ring 120 by cross-section along line 3' of FIG. 2. Surrounding a perimeter of gauge 150 are four fasteners 151, 152 that pass through plate 158 and into corresponding holes at a top surface of yoke 112. In order for mount 100 to operate precisely and repetitively, a pair of pins 153 are also provided that pass into mating and precisely fitting holes. This combination of fasteners and pins is used not only to fasten gauge 150 to yoke 112, but similar combinations of fasteners and pins are used elsewhere. This combination of pins and fasteners provides the benefits of ready self alignment through the pins, precision positioning, and durability to withstand the repeated shocks of bullets or other projectiles being fired. Without the pins, the plates may shift by necessary tolerances between bolts and threaded holes during recoil, which would alter critical alignment and make repeat shots less reproducible.

Adapter 154 is used to mount gauge 150 into plate 158 and allow relative adjustment there between, as will be described herein below. In a central region of adapter 154 is an adjustably extended tip 155, which extends from gauge head 150. As is known in the industry, gauge 150 may be rotated to extend tip 155 by very small, precise and repeatable amounts. This extended tip 155 will most preferably be used to push clamping ring 120 down relative to plate 158, thereby precisely controlling the angular orientation of scope 10 with respect to support bar 110. While tip 155 could be of ordinary softer materials, as could clamping ring 120, most preferably clamping ring 120 has been provided with a surface 122 having a cylindrical groove 123 therein. Pressed into groove 123 and thereby retained therein is a cylindrical bearing 124 or the like, which preferably extends slightly above the surface 122. Bearings are preferred, owing to their intrinsic hardness and durability, which coincides with the needs of the present invention. As is known in the field, a rifle or gun recoils. While various weights and devices are commonly provided to reduce the total amount of recoil, there is nevertheless some shock delivered through the firearm and into the mount and sight. A hardened surface prevents this shock from denting or deforming either ring 120 or gauge 150. Preferably tip 155 and bearing 124 will both be a hard alloy or treated material such as used in the manufacture of bearings. Until screws 108 are tightened down, plate 113 will slide freely up and down along groove 119. The maximum amount of vertical travel is limited by tip 155, the length of groove 119, and the spacing between the end of sight 10 and the rifle barrel. The elevation of yokes 112, 114 above support bar 110 can be increased or decreased to allow more or less longitudinal tilt in sight 10.

Under the bottom side of ring 120, between ring 120 and support bar 110, springs may optionally be provided which will then compress between ring 120 and yoke 112 and serve to bias ring 120 away from support bar 110. In the preferred embodiment, no springs are used, and ring 120 will be manually biased prior to locking by tightening screws 108.

In operation, base 102 will be fastened onto a rifle barrel or other device for which precisely adjustable sighting is desired through large distance or elevation deviations. Base 102 may be machined or formed differently than illustrated herein, to accommodate a particular barrel or mounting arrangement. Base 102 will then vary from one application to another, and will typically be designed to accommodate only one or a few select models, such as a particular manufacturer's rifle, gun or the like.

Once mounted to the rifle barrel or the like, shoulder bolts 116 should be sufficiently loose to allow pivoting of clamping ring 130 with respect to yoke 114. Similarly, bolts 108 are sufficiently loose to allow clamping ring 120 to slide up and down within yoke 112. With these bolts 108, 116 so loosened, the user will press bearing 124 against tip 155. Adjustment of gauge 150 will raise or lower extendible tip 155 with respect to the end of yoke 112, thereby raising or lowering clamping ring 120 with respect to support bar 110. In the preferred embodiment, this adjustment will serve as a potentially large but relatively coarse adjustment. Once this adjustment is made, finer variations, such as are used to change deviation over shorter distances, may be made through the scope up-down adjustment 20. Most preferably, yokes 112, 114 will be held to very tight tolerances, as will clamping rings 120, 130. This allows rings 120, 130 to nest tightly into yokes 112, 114, thereby preventing any left and right angular deviation that might otherwise occur. If, as shown in the preferred embodiment, a micrometer gauge is used, an adjustment screw 159 such as shown in FIG. 2 may be provided, which allows gauge 150 to be "sighted in", or precisely set for a particular angle of elevation or distance of trajectory, ensuring the accuracy of gauge 150. Adjustment screw 159 in the preferred embodiment illustrated herein interacts with adapter 154 to allow gauge 150 to be rotated, raised or lowered with respect to plate 158, or to alternatively lock adapter 154 in position relative to plate 158.

In use, a standard telescopic sight will only provide adjustment that allows sighting through distances measured in hundreds of yards or meters. While this is adequate for close range target shooting or hunting, the present invention expands the capability of sighting by providing adjustment through distances that are measured in thousands of yards and even miles or kilometers. To use adjustable mount 100, the distance between target and rifleman is first determined. Various ballistics tables are available that show the drop of a particular bullet through a particular distance. These tables are used as is known to calculate the angular adjustment required by a sight. If this is greater than the capability of sight 10, then bolts 108, 116 may be loosened, gauge 150 adjusted to set the new angular orientation very precisely, to attempt to zero the sight at the intended distance, and then bolts 108, 116 once again tightened. In the event the bullet or projectile passes higher or lower than intended, or varies right to left, final adjustment to the sight may then be made through up-down and left-right adjustments 20, 30 already available in telescopic sight 10. Alternatively, the process of loosening and tightening bolts 108, 116 may be repeated.

Once elevation compensation is selected for bullet drop compensation, windage may also be adjusted. This may occur either prior to or after bullet drop compensation, owing to the independence of function provided by the present invention. Windage is adjusted through the setting of a second gauge 160 which resembles gauge 150 in both feature and function. An adapter 164 is provided for mounting gauge 160 into support bar 10 and a pin 111 is rigidly anchored into base 102. The gauge 160 may be adjusted with interaction between tip 165 and pin 111 to accurately set windage.

As will now be apparent, gauge 150 may be calibrated to read either in fractions of an inch or millimeters, or may alternatively be calibrated to a specific firearm and bullet to read specifically in target distance. The present invention may therefore be readily adapted through a variety of specific embodiments to accommodate a wide range of sights used with firearms, weapons or other devices in concert with a telescopic scope. Consequently, while the foregoing details what is felt to be the preferred and additional alternative embodiments of the invention, no material limitations to the scope of the claimed invention are intended. The variants that would be possible from a reading of the present disclosure are too many in number for individual listings herein, though they are understood to be included in the present invention. Further, features and design alternatives that would be obvious to one of ordinary skill in the art are considered to be incorporated also. The scope of the invention is set forth and particularly described in the claims herein below.

I claim:

1. An adjustable mount for attaching a longitudinally extending sight to a gun barrel, comprising:

a first pivotal mount to which said longitudinally extending sight is affixed at a first location and about which said sight may be rotated relative to said mount;

a second adjustable mount generally encompassing and retaining said longitudinally extending sight at a second location longitudinally distal to said first location and generally encompassing said longitudinally extending sight to thereby distribute forces transmitted from said gun barrel to said sight about a circumference of said longitudinally extending sight;

a yoke adjacent said second adjustable mount which restrains said second adjustable mount against motion perpendicular to an arcuate path extending radially about said first pivotal mount and which thereby maintains general longitudinal orientation of said longitudinally extending sight;

a guide cooperative with said yoke and said second adjustable mount to restrain motion of said second adjustable mount with respect to said yoke to said arcuate path extending radially about said first pivotal mount; and a locking fastener having means cooperative with said yoke, said adjustable mount and said guide which operatively locks said second adjustable mount into place relative to said yoke in one of a plurality of angular orientations with respect to said first pivotal mount and which provides balanced forces about said second adjustable mount to maintain longitudinal orientation of said longitudinally extending sight during said operative locking of said locking fastener.

2. The adjustable mount of claim 1 further comprising an adjustable gauge for accurately measuring a movement of said second adjustable mount with respect to said yoke in said arcuate path and thereby providing measurable and repeatable compensation for bullet drop.

3. The adjustable mount of claim 2 further comprising a gauge support bridging and removable from said yoke and supporting and precisely locating said adjustable gauge with respect to said yoke.

4. The adjustable mount of claim 3 further comprising a pin and threaded fastener attachments between said gauge support bridge and said yoke, said pin pressed there between and having minimal tolerance to restrain motion between said gauge support bridge and said yoke during and subsequent to a firing of said rifle.

5. The adjustable mount of claim 4 further comprising:

a base affixed to said gun barrel and supporting said yoke; and a windage adjustable gauge for pivotally locating said yoke about an axis generally perpendicular to a longitudinal extension of said gun barrel.

6. The adjustable mount of claim 1 wherein said first pivotal mount further comprises a split ring circumscribing said longitudinally extending sight.

7. The adjustable mount of claim 6 further comprising:

a forward yoke extending between said gun barrel and said first location adjacent said longitudinally extending sight; and shoulder bolts passing through said forward yoke and into said split ring.

8. The adjustable mount of claim 1 wherein said second adjustable mount further comprises a split ring circumscribing said longitudinally extending sight.

9. The adjustable mount of claim 1 wherein said guide further comprises slots machined through said yoke.

10. The adjustable mount of claim 1 wherein said locking fastener further comprises a first bolt and a first washer extending through said yoke into a first side of said second adjustable mount and a second bolt and a second washer extending through said yoke into a second opposed side of said second adjustable mount.

11. A rifle mount for supporting a telescopic sight upon a barrel of said rifle and having compensation adjustments of vertical angle for bullet drop and horizontal angle for windage that exceed any adjustments available within said telescopic sight, comprising:

a forward support for said telescopic sight pivotal about a first horizontal axis and secured against motion about a vertical axis;

a rearward support for said telescopic sight pivotal about said first horizontal axis and secured against motion about a vertical axis;

a means for accurately measuring an angle of orientation between said telescopic sight and said rifle barrel;

a means cooperative with said rearward support for locking said rearward support against motion about said first horizontal axis;

a means for supporting said rearward support relative to said rifle barrel pivotal about a vertical axis; and a means for locating said rearward support at a second angle of orientation measured upon said vertical axis between said telescopic sight and said rifle barrel.

12. The rifle mount of claim 11, wherein said means for locating said rearward support further comprises an adjustable gauge for accurately measuring said second angle of orientation.

13. A gun mount for mounting a telescopic sight to a gun, comprising:

a forward yoke;

a means for pivotal attachment between said forward yoke and said telescopic sight rotatable about an axis compensating for bullet drop;

a rearward yoke rigidly aligned with said forward yoke;

a means for supporting said telescopic sight within said rearward yoke and locking said telescopic sight relative to said rearward yoke;

a base having means to anchor rigidly to said gun; and a means to pivot said forward yoke and said rearward yoke about said base about an axis compensating for windage.

* * * * *